US011852456B2

(12) United States Patent
Munroe et al.

(10) Patent No.: US 11,852,456 B2
(45) Date of Patent: Dec. 26, 2023

(54) ENHANCED SAFETY AND RELIABILITY FOR A NETWORKED DETONATOR BLASTING SYSTEM

(71) Applicant: Austin Star Detonator Company, Cleveland, OH (US)

(72) Inventors: Chris Munroe, Collins, OH (US); Larry S. Howe, Norwalk, OH (US); Bryan E. Papillon, Phoenixville, PA (US); Gimtong Teowee, Westlake Village, CA (US); Walter J. Harders, Rocky River, OH (US)

(73) Assignee: AUSTIN STAR DETONATOR COMPANY, Cleveland, OH (US)

( * ) Notice: Subject to any disclaimer, the term of this patent is extended or adjusted under 35 U.S.C. 154(b) by 75 days.

(21) Appl. No.: 16/978,342

(22) PCT Filed: Mar. 7, 2019

(86) PCT No.: PCT/US2019/021167
§ 371 (c)(1),
(2) Date: Sep. 4, 2020

(87) PCT Pub. No.: WO2019/173601
PCT Pub. Date: Sep. 12, 2019

(65) Prior Publication Data

US 2021/0003377 A1 Jan. 7, 2021

Related U.S. Application Data

(60) Provisional application No. 62/639,668, filed on Mar. 7, 2018.

(51) Int. Cl.

| | |
|---|---|
| ***F42D 1/055*** | (2006.01) |
| ***F42D 5/00*** | (2006.01) |
| *F42B 3/12* | (2006.01) |

(52) U.S. Cl.
CPC ..... *F42D 1/055* (2013.01); *F42D 5/00* (2013.01); *F42B 3/122* (2013.01)

(58) Field of Classification Search
CPC ..... F42D 1/055; F42D 5/00; F42B 3/122
(Continued)

(56) References Cited

U.S. PATENT DOCUMENTS 4,374,492 A * 2/1983 Goldberg ..... F42B 12/58 102/427
10,521,598 B2 * 12/2019 Hofleitner ..... F42B 3/087
(Continued)

FOREIGN PATENT DOCUMENTS

CN 103618302 A 3/2014
CN 206212014 U 5/2017
(Continued)

OTHER PUBLICATIONS

Davey Bickford Enaex, "DaveyTronic® SP digital blasting system for large open pit mining operations", https://www.daveybickfordenaex.com/australia/english/systems-services/daveytronic-sp/, downloaded on Apr. 16, 2021, 3 pages.
(Continued)

*Primary Examiner* — Joshua E Freeman
*Assistant Examiner* — Benjamin S Gomberg
(74) *Attorney, Agent, or Firm* — Lippes Mathias LLP

(57) ABSTRACT

Ethernet systems, methods and blasting machines are presented for remote turn on of the blasting machine and reliable fire and arm commands issuance. Systems, methods, blasting machines and wireless bridge units are presented for wireless blasting for safe firing of detonators under control of a remote wireless master controller in which the blasting machine is connected by cabling to the wireless bridge unit and power to a firing circuit of the blasting machine is remotely controlled via the bridge unit. The bridge unit or
(Continued)

Ethernet primary controller selectively provides first and second firing messages to the blasting machine contingent upon acknowledgment of safe receipt of the first firing message by the blasting machine, and the blasting machine fires the connected detonators only if the first and second firing messages are correctly received from the bridge unit.

18 Claims, 14 Drawing Sheets

(58) Field of Classification Search
USPC ..... 102/215
See application file for complete search history.

(56) References Cited

U.S. PATENT DOCUMENTS

| | | | | |
|---|---|---|---|---|
| 2003/0029344 | A1* | 2/2003 | Eddy | F42D 1/05 102/200 |
| 2006/0272536 | A1 | 12/2006 | Lownds et al. | |
| 2009/0145321 | A1* | 6/2009 | Russell | F42D 1/05 102/200 |
| 2009/0314176 | A1 | 12/2009 | Lownds et al. | |
| 2010/0073493 | A1 | 3/2010 | Godfrey et al. | |
| 2011/0308415 | A1* | 12/2011 | Bruschi | F42C 17/04 102/215 |
| 2013/0192486 | A1* | 8/2013 | Ruggiero | F42B 4/00 102/215 |
| 2016/0033248 | A1* | 2/2016 | Mace | F42D 1/02 102/215 |
| 2017/0074630 | A1* | 3/2017 | Kotsonis | F42D 1/05 |
| 2017/0089680 | A1* | 3/2017 | Papillon | F42D 5/00 |
| 2017/0261295 | A1* | 9/2017 | Emrich | G01S 19/19 |
| 2021/0003377 | A1 | 1/2021 | Monroe et al. | |

FOREIGN PATENT DOCUMENTS

| | | | | |
|---|---|---|---|---|
| WO | 2015084707 | A2 | 6/2015 | |
| WO | WO-2015084707 | A2 * | 6/2015 | F42D 1/045 |
| WO | WO 2016/012646 | A1 | 1/2016 | |
| WO | WO 01/59401 | A1 | 8/2021 | |

OTHER PUBLICATIONS

Davey Bickford Enaex, "DaveyTronic® Underground digital blasting system", https://www.daveybickfordenaex.com/australia/english/systems-services/daveytronic-ug/, downloaded Apr. 16, 2021, 3 pages.

Davey Bickford Eanex, "DaveyTronic® Underground and Tunneling Digital Blasting System / Electronic Detonators", https://www.enaex.com/wp-content/uploads/2018/05/2017-UK-DaveyTronic-UG1.pdf, downloaded Apr. 16, 2021, 4 pages.

"Blasting in Chile: With the task of generating more R&D", https://www.mch.cl/informes-tecnicos/tronadura-en-chile-con-la-tarea-de-generar-mas-id/#, downloaded Apr. 16, 2021, 4 pages.

Davey Bickford, "DaveyTronic®SP Surface mining Digital blasting system / Electronic Detonators",https://sasoldcproducts.blob.core.windows.net/documents/Product%20Brochures/ZA_Explosives_DTSP%20Product%20Sheet.pdf, downloaded Apr. 16, 2021, 3 pages.

International Search Report and Written Opinion for PCT/US2019/021167 dated May 14, 2019, 6 pages.

Extended European Search Report for PCT/US2019/021167 dated Oct. 19, 2021, 9 pages.

Appeal Filed in Chilean Patent Application No. 202002309, dated Jul. 28, 2023.

"Centralised Blasting—Increasing Production by Eliminating Downtime Before and During Blasting"; Dyno Nobel Inc.; 2014.

* cited by examiner

ENHANCED SAFETY AND RELIABILITY FOR A NETWORKED DETONATOR BLASTING SYSTEM

REFERENCE TO RELATED APPLICATION

The present application is a national stage application of international application PCT/US2019/021167 which was accepted under 35 USC § 371, and which claims priority to, and the benefit of, U.S. provisional patent application No. 62/639,668, entitled "ENHANCED SAFETY AND RELIABILITY FOR A NETWORKED DETONATOR BLASTING SYSTEM", and filed on Mar. 7, 2018, the entirety of which applications are hereby incorporated by reference.

TECHNICAL FIELD

The present disclosure relates to blasting networked systems for electronic detonators.

BACKGROUND

In blasting operations, detonators and explosives are buried in the ground, for example, in holes (e.g., bore holes) drilled into rock formations, etc., and the detonators are wired for external access to blasting machines that provide electrical signaling to initiate detonation of explosives. Electronic detonators can implement programmable delay times such that an array of detonators can be actuated in a controlled sequence. The blasting machine is normally turned on and a blast sequence includes power up, verification and/or programming of delay times, arming and finally issuance of a "fire" command. The blasting machine provides sufficient energy and voltage to charge the firing capacitors in the detonators, and initiates the actual detonator firing in response to the fire command. During the firing phase, the blasting machine fires the detonator array.

SUMMARY

Various aspects of the present disclosure are now summarized to facilitate a basic understanding of the disclosure, wherein this summary is not an extensive overview of the disclosure, and is intended neither to identify certain elements of the disclosure, nor to delineate the scope thereof. Instead, the primary purpose of this summary is to present some concepts of the disclosure in a simplified form prior to the more detailed description that is presented hereinafter. Disclosed examples include apparatus and techniques for remote turn on of the blasting machine and reliable fire and arm commands issuance.

BRIEF DESCRIPTION OF THE DRAWINGS

The following description and drawings set forth certain illustrative implementations of the disclosure in detail, which are indicative of several exemplary ways in which the various principles of the disclosure may be carried out. The illustrated examples, however, are not exhaustive of the many possible embodiments of the disclosure. Other objects, advantages and novel features of the disclosure will be set forth in the following detailed description of the disclosure when considered in conjunction with the drawings, in which.

DETAILED DESCRIPTION

Figure 1:
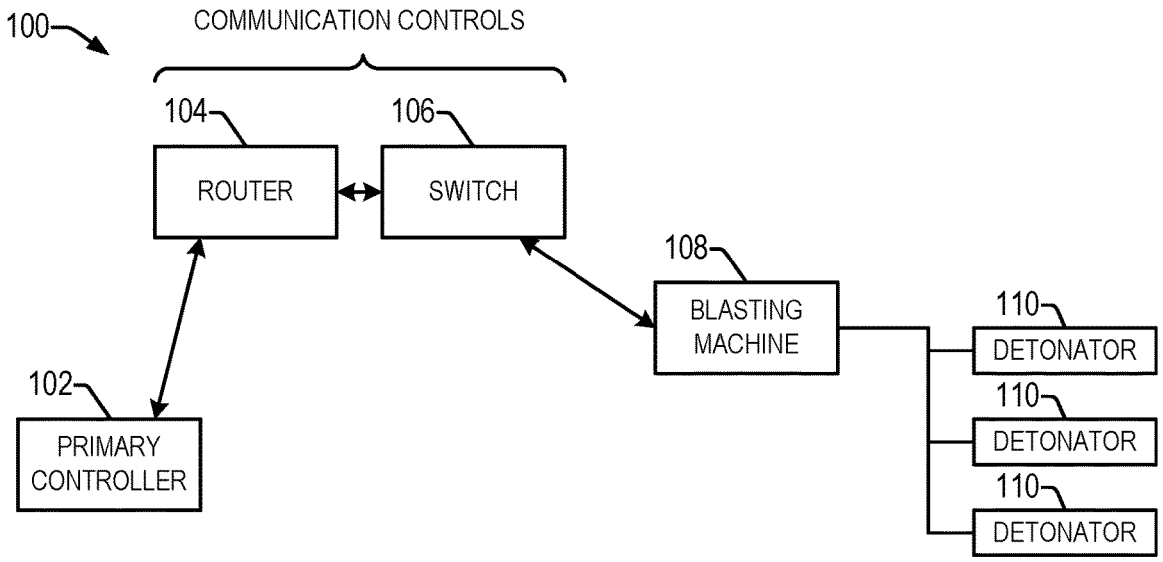
FIG. 1 is a block diagram of a networked electronic blasting system.

Referring now to the figures, several embodiments or implementations of the present disclosure are hereinafter described in conjunction with the drawings, wherein like reference numerals are used to refer to like elements throughout, and wherein the various features are not necessarily drawn to scale.

FIG. 1 shows an example networked blasting system 100 for electronic detonators 110, which can be used in a variety of applications, for example, in underground mines. The, system 100 includes a primary controller 102 (e.g., an Ethernet controller), a communication device formed by a router 104 and a switch 106 that is connected to an Ethernet compatible blasting machine 108. The Ethernet blasting machine 108 is wired to an array of detonators 110 in a blasting array. The network system 100 uses digital communication bus protocols e.g., Ethernet, CAN, RS-232, RS-422 or RS-485. The primary controller 102 is configured to communicate via any suitable general network or connection (e.g., WiFi, UHF, USB, optical fiber, etc.) With such configuration no extra long leadline is needed to connect the primary controller to the array of detonators. Maximum range is determined from the length and type (i.e. copper or fiber optic) of the established network lines laid out in the mines, for example, from 1-5 miles away. Additionally the primary controller 102 can be positioned more flexibly anywhere, and there are no limitations as to where the primary controller 102 is laid out in the wired networked system 100.

In such a blasting system 100, the blasting machine 108 is connected but not energized until remotely commanded via primary controller together with the communication controller 104, 106 as the operator walks from the blast area to the primary controller site some distance away. The blast sequence includes power up, verify and/or program the delay times, arming and finally the fire command. The blasting machine 108 contains sufficient energy, voltage to charge the firing capacitors in the electronic detonators 110.

In the arm stage, a command is issued to all the detonators 110 to charge the firing capacitors in the electronic detonators 110.

During the firing phase, upon a blaster's input, a fire command is transferred from the primary 102 through the communication controls 104, 106, which then issues the final fire command to fire the entire array of detonators 110. In some systems, only a single fire command is transmitted to the blasting machine 108 from the primary controller 102 to initiate the final blasting of the array of detonators 110. In certain examples in the illustrated system 100, the primary 102 issues first and second fire commands, with corresponding CRC checks and a timeout check in order to facilitate safe operation of the system 100, as seen further below in FIG. 3.

Because the arm and fire commands involve the energization and firing of the electronic detonators 110, disclosed examples provide a reliable and safe method to facilitate proper receipt and action in response to the commands.

Disclosed examples provide enhanced safety of a networked electronic detonator blasting system 100 by using a remote turn on of the blasting machine 108 and a more reliable fire and arm commands issuance. By having the remote turn on, the blasting machine is not powered up even though the branchlines or leadline are connected with the array of detonators 110. Rather, the blasting machine 108 is only turned on when the unit establishes a link to the primary controller 102, and the blasting machine is enabled by the primary controller 102. A second or more of the arm/fire commands issued by the primary controller 102 are used in certain examples to ensure that it is a valid command to arm/fire and to diminish any inadvertent perception of an arm/fire command.

When the leadline is connected to the blasting machine 108, the blasting machine 108 does not energize the bus lines connected to the blasting array of detonators 110, even though it is connected to the network. Therefore the array of detonators 110 on the entire bus is not electrically connected to any live or powered bus line. The blasting machine 108 in one example implements a remote turn on feature, upon the proper turn on command from the Ethernet controller (e.g., primary 102), and in response, applies power to the bus line containing the electronic detonators 110.

In one example, successful reception of multiple fire or arm commands from the primary 102 to the blasting machine 108 is used by firmware of one or more microcontrollers in the blasting machine 108 as a gating condition to be interpreted as a valid fire or arm command. Absent this advantageous feature, even with a CRC check at the end of the received serial Ethernet packet, there is a finite possibility of a command other than a fire or arm being construed as an unintended fire or arm command, e.g., simultaneous bit flips in both the command bytes and CRC. Therefore the reliability and safety of a fire or arm command is significantly enhanced by having valid reception of multiple fire or arm commands plus acknowledgements for each fire or arm command issuance. The likelihood of bit flips of 2 or more sequential commands within the timeout period is extremely low especially with acknowledgement after each fire or arm command.

FIG. 1 shows an Ethernet enabled electronic detonator blasting system 100. Other digital communication bus protocols can be utilized, e.g. CAN, RS-232, RS485, or RS422 in the network. The controller 102 communicates 2-way with the blasting machine 108, in this example, via the router 104 and the switch 106. The primary controller 102 essentially controls the operation of the blasting machine 108 remotely. In one example, all functions, status, and messages are displayed or echoed on the primary controller display screen 102, to enable the operator of the primary controller 102 to see whatever is on the blasting machine display safely at a considerable distance away. In one example, the blasting system includes multiple Ethernet addressable switches configured to selectively turn off or on selected branch lines to a main leadline during logging or blasting operation. In one example, the blasting system includes one or more security keys that must be entered or inserted in order to enable the blasting system and communicate with an array of the detonators. Individual and separate security keys are required in one example to initiate communication, charge and fire a network of detonators.

Figure 2:
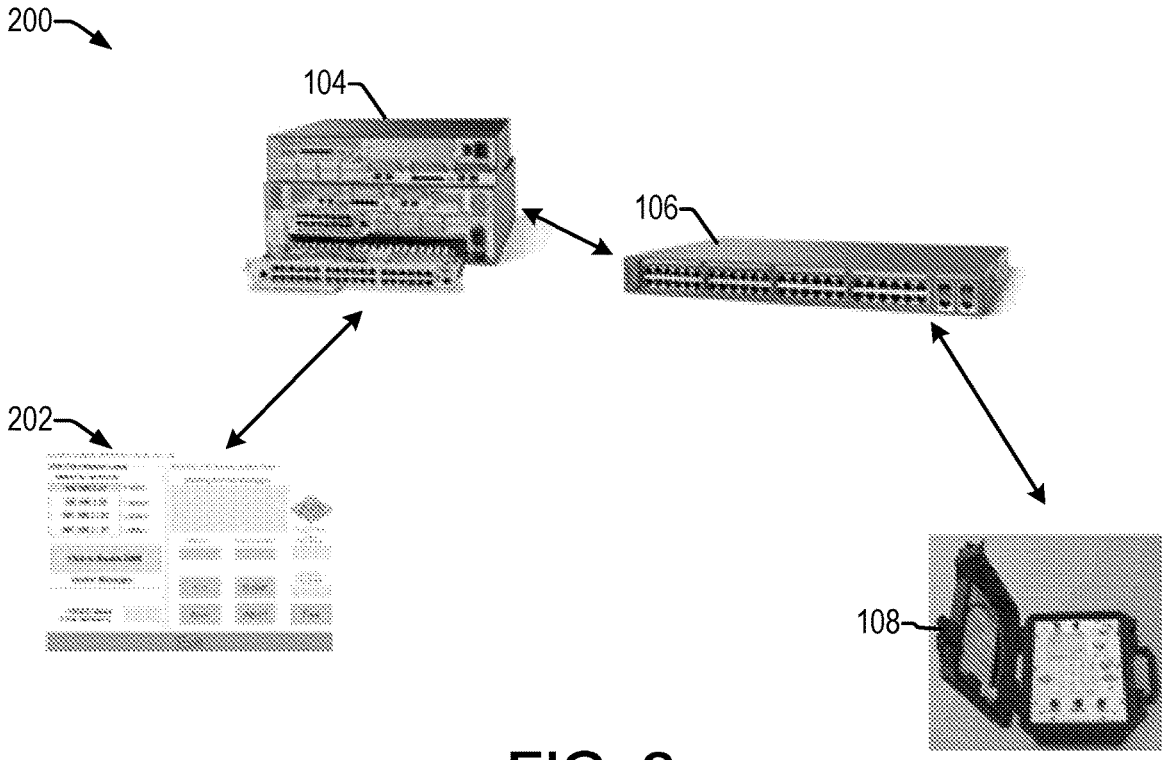
FIG. 2 is a block diagram of a networked electronic blasting system.

FIG. 2 is a block diagram of another example networked electronic blasting system 200, including a PC-based primary controller 202, along with a router 104, a switch 106, and a blasting machine 108 as described above. In this example, the primary controller 202 includes a blasting machine equipped with an Ethernet controller, or PC software with Ethernet capability. The primary 202 in this case is implemented using the PC software, and the primary 202 communicates through the Ethernet network to the blasting machine 108, which in turn is connected to the array of electronic detonators via a leadline (not shown in FIG. 2).

Figure 3:
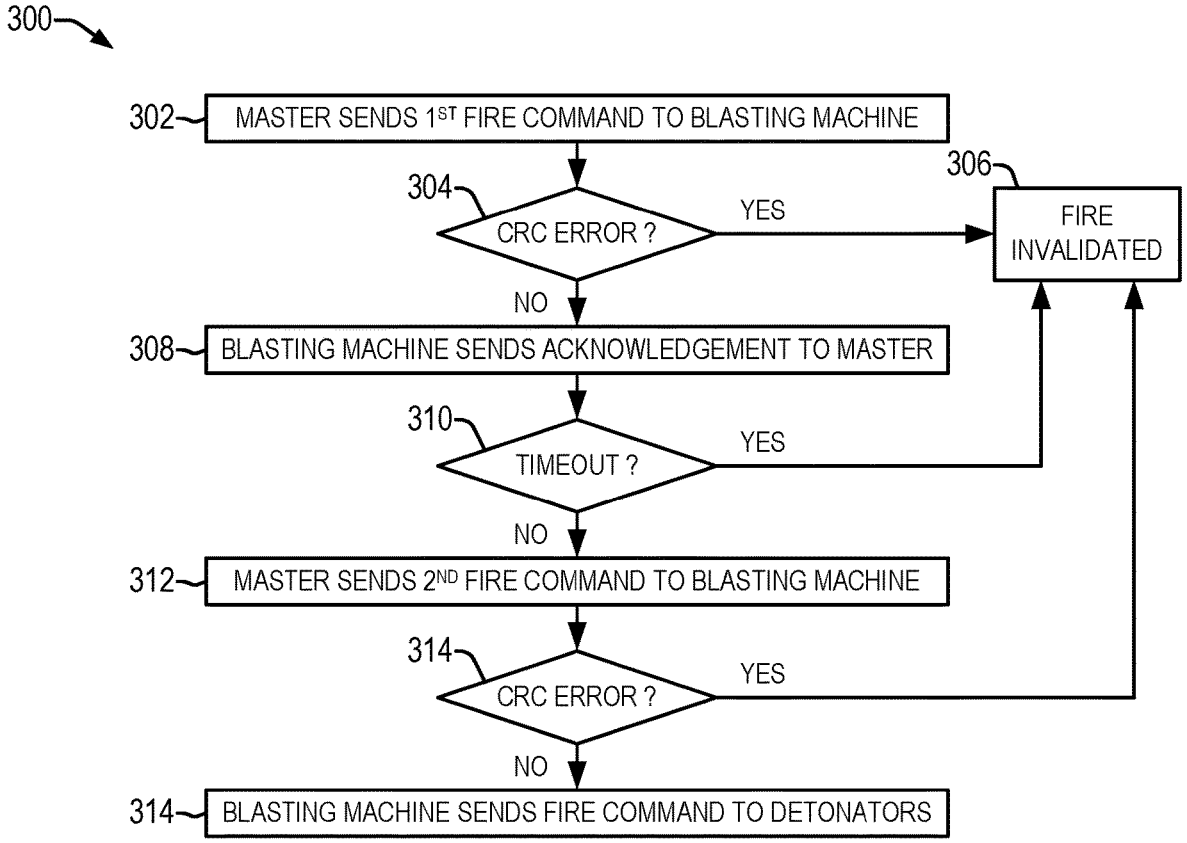
FIG. 3 is a flow diagram of a fire command issuance by a primary device to a blasting machine.

FIG. 3 is a flow diagram of a process 300 including a fire command issuance by a primary device 102, 202 to a secondary blasting machine 108. During a fire command phase, upon detection of a valid fire command issued by the primary 102 (302 in FIG. 3), the blasting machine 108 checks for any CRC errors at 304, and invalidates the fire command at 306 if any CRC error is detected. If there are no CRC errors at 304, the blasting machine 108 sends an acknowledgment to the primary device 102, 202 at 308 to acknowledge safe receipt of the first fire command. If the controller 102, 202 does not receive an acknowledgment within a predetermined time, a timeout error is processed at 310, and the fire command is invalidated at 306. If the controller 102, 202 receives the expected acknowledgment at 308 before the timeout period has expired (NO at 310), the primary controller 102 sends a second fire command to the blasting machine 108 at 312 in FIG. 3. In one example, the blasting machine 108 implements a second timeout check, beyond which if there is no second or further fire commands, this will be treated as an invalid fire command or an automatic abort and therefore the fire command is not enabled or accepted by the blasting machine 108. Continuing in the example of FIG. 3, the blasting machine 108 performs a CRC error check at 314 on the received second fire command, and if any CRC errors are detected (YES at 314), the fire command is invalidated at 306. If no CRC errors are detected in the second fire command (NO at 314), the blasting machine 108 sends the fire command to the detonators 110 at 314 to complete the firing process 300.

Figure 4:
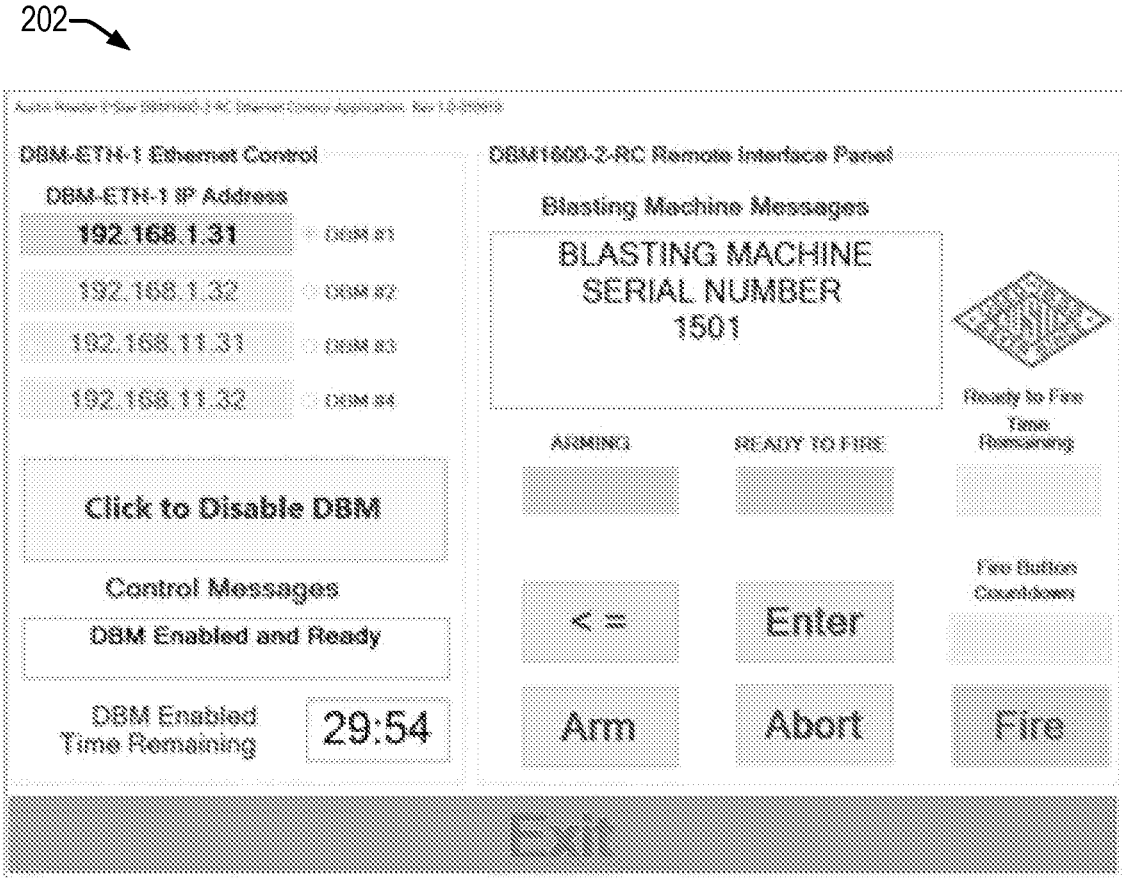
FIG. 4 is a diagram of a PC software to control the blasting machine using Ethernet protocol.

FIG. 4 illustrates an example display screen of a PC-based software implementation of the primary controller 102.

In one example of a blast using an Ethernet enabled electronic blasting system to initiate the firing, the following operations are present:

a) The electronic detonators are appropriately programmed and logged using a logger or set of loggers. The delay times may be programmed during the logging process or they may been pre-programmed previously.
b) The detonators are then connected to each of their individual branch wires.
c) The logger is used to verify that each and every detonator in the specific branch are all present and accounted for to ensure electrical connection.
d) The detonator data are transferred to the blasting machine.
e) The branches wires are next connected to the leadline wire.
f) The blast area is now cleared to personnel and/or equipment.
g) The leadline goes to the blasting machine some distance away.
h) The blasting machine is not powered up at all thus no power, current or voltage is present on the leadline all the way to the array of detonators.
i) At the blasting site, the PC software is executed. An Ethernet communication link is established between the PC and the selected blasting machine with the appropriate Ethernet address and protocol. Once the link is established, the powered is applied to the blasting machine.
j) The user will use the PC to issue commands such as verify and charge the detonators. These commands are relayed to the blasting machine to verify and to arm the electronic detonators in the entire array. During the verify phase, any missing detonators will be flagged. During the arming phase, the firing capacitors in the electronic detonators are charged up. Calibration is also performed during this phase. Any error in the blasting machine will be echoed back to the remote display; thus the user has instant access and control over the entire blast process.
k) Finally, when ready for the firing phase, the fire button(s)—a sequence of fire and arm button press for redundant safety) is pressed, the PC sends the fire command to the blasting machine. It is acknowledged and the PC then sends another fire command as a confirmation to the blasting machine within a specific time period. Subsequently the blasting machine will then issue the digital encoding for the fire signal to the array of detonators.
l) After the fire phase, power is then turned off to the blasting machine by the PC.

In another example implementation, the multiple arm/fire command scan also be sent to the blasting machine 108 without any acknowledgement by the blasting machine 108 back to the bridge or primary controller 102, 202 for the successive arm/fire commands to follow. In one example, the fire commands can be sent within a spaced timeout which the blasting machine 108 expects to receive in a row before a valid signal to arm/fire is interpreted.

In case of any Ethernet communications breakdown, the slave blasting machine 108 will revert to a safe state, namely discharge and shut down the bus line after a predetermined time of no communications from the primary controller 102, 202.

For multiple secondary blasting machines 108, the system 100, 200 can accommodate synchronize firing of all the detonators 110 (e.g., with or without any programmed delay times). In one example, the primary controller 102, 202 sends broadcast fire commands to the addressed secondary devices (e.g., secondary blasting machines 108) on the Ethernet network via the router 104 and switch 106, or multiple routers and/or switches, to ensure that the multiplicity of secondary blasting machines 108 receive and act on the fire commands with the same time reference. In one example, no acknowledgments are issued to avoid any contention if the secondary is responding back individually to the fire command received, although not a strict requirement of all possible implementations.

Added software safety controls in various examples include: (1) an automated countdown timer implemented by the blasting machine 108 which will shut down the blasting machine 108 if no operator command activity is detected for a predetermined time period, such as for 30 minutes. Example software safety controls also include (2) an automated countdown timer that only allows the blasting machine 108 to hold the detonators 110 in a charged state with no command activity for 10 minutes. In one example, in order to simulate the arm and fire buttons being held simultaneously for sending the fire command, a countdown timer method is used, including:

After detonators are charged and ready to fire:

Operator presses the arm button,

Countdown timer starts at 5 seconds—allowing operator to press the fire button to send the fire command, If the fire button is pressed before the countdown timer reaches 0, the fire commands will be initiated, If the countdown timer goes to 0 before the fire button is pressed, the software application will abort the fire attempt, and continue to hold in a charged state. The operator must re-start the arm and fire sequence again, and Once the fire command is send and acknowledgement received, the application will automatically turn off the blasting machine within 30 seconds of the fire command being sent.

Figure 13:
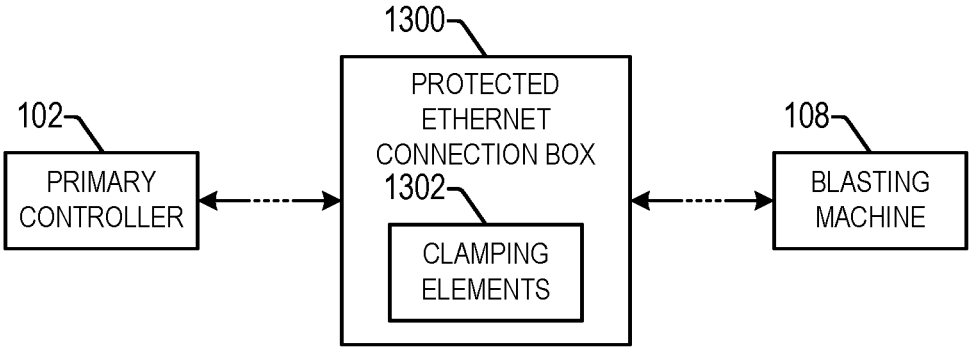
FIG. 13 shows a protected Ethernet connection box operatively coupled in one or more connection paths between a primary controller and a blasting machine.

In one example, the Ethernet blasting machine 108 is configured to turn off in 30 minutes or another predetermined or set time, if no Ethernet communication detected, as a fail safe measure. In one example, when initiating a blast, the primary controller 102 sends multiple Ethernet fire commands via Ethernet packages with necessary acknowledgements, for example, at least two such pairings of fire commands and acknowledgments from the Ethernet blasting machine 108, with a predetermined time window of acceptable acknowledgement after validated reception of one such fire command. In one example, the system includes a protected Ethernet connection box 1300 (FIG. 13) operatively coupled in one or more of the connection paths between the primary controller 102 and the blasting machine 108, including clamping elements 1302 such as Zeners, TVS or SCRs to avoid damage to the entire Ethernet network and to protect the network elements (e.g., the controller 102, the router 104, the switch 106 and/or the blasting machine 108 of FIG. 1 above) against electrical after effects (e.g. plasma and/or high voltage EM fields) associated with a blast or detonation. In certain examples, for synchronized firing of multiple blasting machines 108, each with its own unique Ethernet address, the primary controller 102 issues at least 2 broadcast fire commands with different pre-countdown times to the delay time, and each Ethernet blasting machine 108 is configured to acknowledge reception of the fire commands to the primary controller 102. In one example, if one or more of the blasting machines 108 does not properly acknowledge the fire command, the primary controller 102 implements a last minute abort of the firing, such as a voltage check at time T=0 before commencement of final delay countdown, or a discharge command to all the blasting machines 108.

Certain examples tailor fundamental wireless functionalities to operate within the Ethernet framework to network control an electronic blasting system. Suitable examples of wireless blasting apparatus and methods are described below. Although the following description and drawings show wireless network connections, wired connections can be used instead, or in combination with wireless connections in various implementations. In one example implementation, the blasting machine 402 corresponds to the blasting machine 108 of FIG. 1 above, the slave bridge unit 420 corresponds to one or both of the ethernet router 104 and/or the ethernet switch 106 (e.g., the COMMUNICATION CONTROLS) in FIG. 1, and the master controller 440 corresponds to the primary controller 102 of FIG. 1. Although described hereinafter in the context of wireless communications interconnections between network elements, wired connections are possible alone or in combination with wireless connections, using ethernet or other communications protocol and devices.

Figure 5:
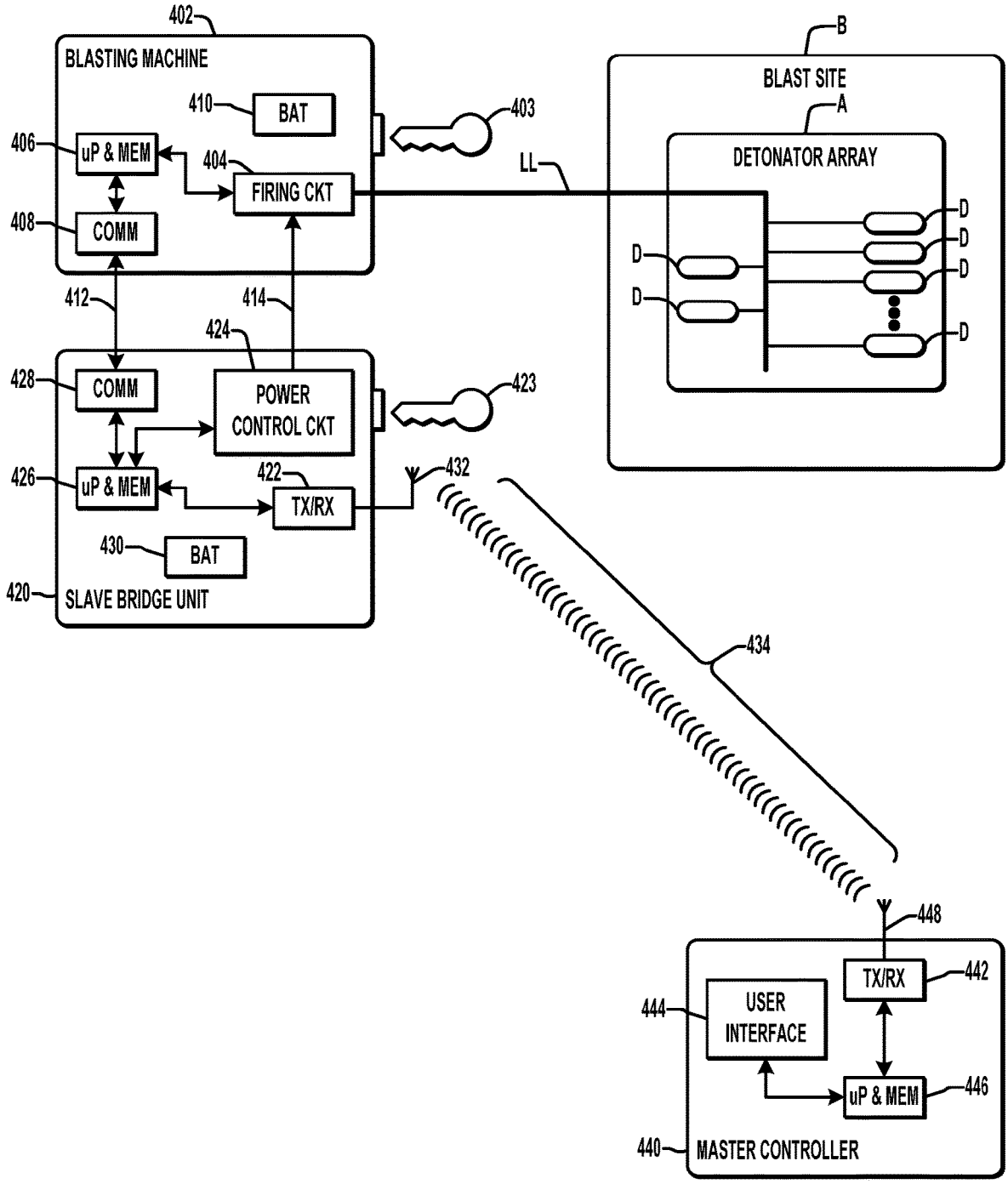
FIG. 5 is a simplified system diagram illustrating a wireless blasting system for remotely firing an array of detonators connected to a blasting machine at a blast site, including a remotely located wireless master controller and a wireless slave bridge unit connected to the blasting machine in accordance with one or more aspects of the present disclosure.

FIG. 5 shows a wireless blasting system with a blasting machine 402 is a wireless-enabled slave bridge unit 420 located at or near a blast site B that includes a detonator array A with a number of electronic detonators D connected by wires to a single pair of lead lines LL. As shown in FIG. 5, the lead lines LL are connected to a firing circuit 404 of the blasting machine 402, although various operational aspects of the disclosed methods and systems contemplate that the lead lines LL may be connected to the firing circuit 404 only at certain points in a blasting process. A key 403 may be associated with the blasting machine 402 for security purposes, for example, to ensure that the blasting machine 402 operates only once a proper key 403 is installed. In other embodiments, password protection may be provided in the blasting machine 402, requiring an operator to enter a proper password to enable blasting machine operation, and the key 403 may be omitted. The blasting machine 402 further includes a microprocessor and associated electronic memory 406 operatively connected to the firing circuit 404 and to a communications interface 408. As is known, the blasting machine 402 may be housed in a suitable environmental enclosure capable of withstanding the rigors and environmental conditions of blasting sites, and the blasting machine 402 in certain implementations includes an internal battery 410 for operation without requiring connection of external power lines. Other embodiments are possible in which the blasting machine 402 does not include an internal power source, and operates exclusively using power supplied from a connected slave bridge unit 420.

The slave bridge unit 420 is really housed in a suitable enclosure and operated by a battery 430, and may have an associated key 423 for operating the unit 420. The slave bridge unit 420 may alternatively or in combination be password-protected, requiring user entry of a password to enable bridge unit operation, and the key 423 may be omitted. One or both of the blasting machine 402 and the slave bridge unit 420 may also include various user interface features (not shown) allowing an operator to perform various operations by pressing buttons, and may provide a display screen or other output means by which an operator can receive data or messages. The slave bridge unit 420 includes a communications interface 428 allowing communication between the slave bridge unit 420 and the blasting machine 421 connected by a communications cable 412. In addition, the slave bridge unit 420 includes a microprocessor and associated electronic memory 426 that is operatively connected to the communications interface 428 as well as to a wireless transceiver 422 having an associated RF antenna 432. Moreover, the illustrated bridge unit 420 includes a power control circuit 424 operative to selectively enable or disable the firing circuit 404 of the blasting machine 402 by any suitable means, including without limitation provision of firing circuit power 414 and/or by providing a power gating control signal 414, 414*a* in order to control the provision of power to the firing circuit 404, examples of which are further illustrated in FIGS. 6 and 7. Also, the slave bridge unit 420 includes an internal battery 430 allowing field operation.

The processors 406, 426 may be any suitable electronic processing device including without limitation a microprocessor, microcontroller, DSP, programmable logic, etc. and/or combinations thereof, which performs various operations by executing program code such as software, firmware, microcode, etc. The devices 402, 420 each include an electronic memory operatively associated with the corresponding processors 406, 426 to store program code and/or data, including computer executable instructions and data to perform the various functionality associated with blasting machine operation as is known as well as communications tasks and the various function set forth herein. The memory of the devices 402, 420 may be any suitable form of electronic memory, including without limitation RAM, EEPROM, flash, SD, a multimedia card, etc.

As further shown in FIG. 5, a master controller apparatus 440 includes a microprocessor and electronic memory 446 operatively coupled with a user interface 444 and a wireless transceiver 442 with an associated RF antenna 448. In operation, the master controller 440 and the slave bridge unit 420 establish a radio-frequency (RF) or other wireless communications link 434 via the transceivers 442, 422 and the corresponding antennas 448, 432, thus allowing the master controller 442 operate the slave bridge unit 420 and hence the blasting machine 402 at a significant distance away from the blast site 408, such as several miles in certain implementations. In this manner, the remote positioning of the master controller 440 facilitates operator safety during blasting operations, with the various concepts of the present disclosure further facilitating operator safety as detailed further below.

Figure 6:
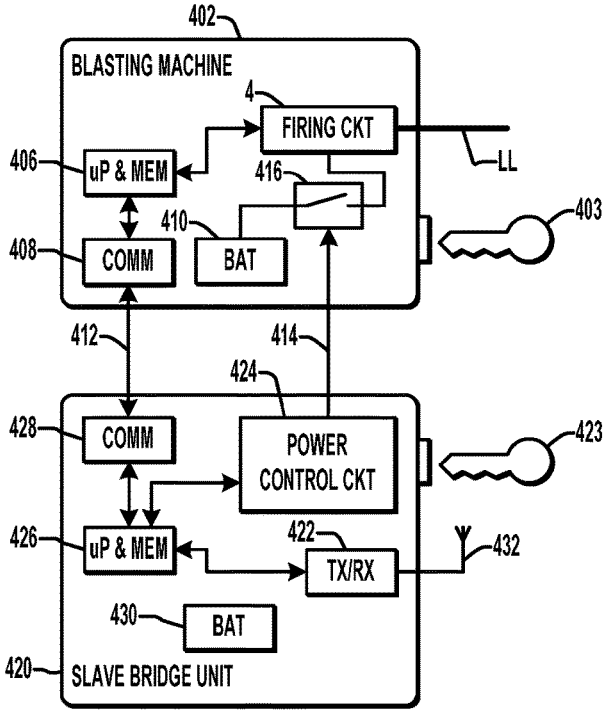
FIGS. 6 and 7 are schematic diagrams illustrating first and second embodiments of the remote turn on and remote turn off features of the blasting machine and slave bridge unit.

FIG. 6 illustrates one possible implementation of the blasting machine 402 and the slave bridge unit 420 facilitating control of the application of electrical power to the blasting machine firing circuit 404 by the slave bridge unit 420. In various situations, the disclosed blasting machine 402 and bridge apparatus 420 advantageously allow remote turn on and/or remote turn off of the firing circuit power, thereby enhancing personal safety for blasting sites. In this implementation, a relay 416 is provided in the blasting machine 420 for selectively connecting power from the blasting machine battery 410 to the firing circuit 404 according to a switching control signal 414 provided by the power control circuit 424 of the slave bridge unit 420. The control signal 414 can be provided from the bridge unit 422 the blasting machine 402 by a variety of means, including a dedicated control line in a communications cable 412, 414 connecting the units 420 and 402. In another possible embodiment, the power control circuit 424 is implemented in programming of the processor 426, with the processor 426 providing a command message via the communications interfaces 428, 408, with the blasting machine processor 406 controlling operation of the relay 416 accordingly, wherein the switching control signaling 414 is provided via such messaging between the units 420, 402. Other possible implementations may be used by which the slave bridge unit 420 selectively controls the application of power to, or removal of power from, the firing circuit 404 to selectively enable or disable the firing circuit 404 of the blasting machine 402. In this manner, the power control circuit 424 operates under control of the slave bridge unit processor 426 to selectively provide the control signal 414 to either apply power to the blasting machine firing circuit 404 or to ensure that the firing circuit 404 is unpowered.

Figure 7:
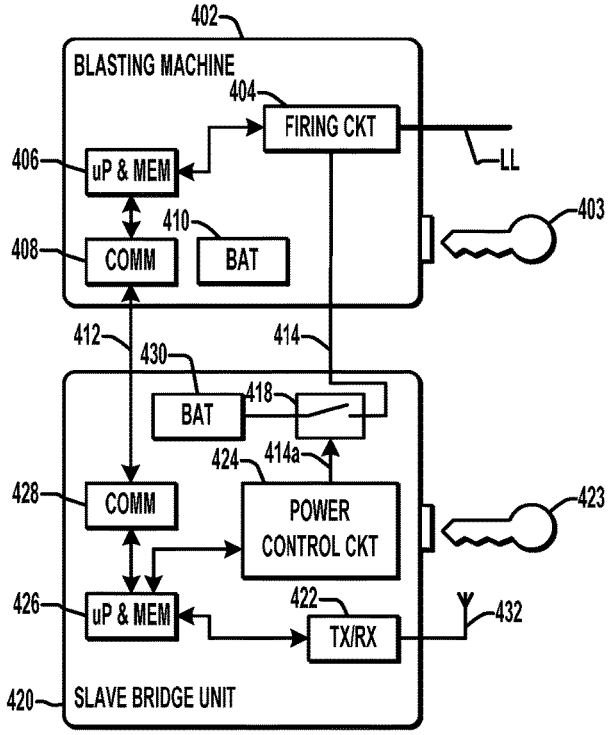

FIG. 7 illustrates another non-limiting embodiment in which a dedicated power line is provided in cabling connecting the blasting machine 402 with the bridge unit 420, including a single wire or pair of wires 414, where a single cable may also include the communications line or lines 412, or separate cabling can be provided. The slave bridge unit 420 in FIG. 7 includes an on-board relay 418 operative to selectively apply power from the bridge unit battery 430 to the firing circuit 404 of the blasting machine 402 according to a switching control signal 414*a* from the power control circuit 424. As in the implementation of FIG. 6, the power control circuit 424 may be a separate circuit operated under control of the bridge unit processor 426, or may be implemented via programming of the processor 426 to selectively provide the switching control signal 414*a* to operate the relay 418 to thereby selectively apply power from the battery 430 to the firing circuit 404, or to ensure that the firing circuit 404 is unpowered according to the state of the switching control signal 414*a*.

In the illustrated implementations, a single contact relay 416, 418 may be used, for example, to connect a positive DC power line to the firing circuit 404, or a relay 416, 418 may be used having multiple contacts, for instance, to selectively connect or disconnect multiple power lines to or from the firing circuit 404. In one possible implementation, the bridge unit processor 426 performs remote turn on of the firing circuit power by asserting the control signal 414 after connection of the bridge unit 422 the blasting machine 402 only after a verified communications link 434 is established between the master control unit 440 and the slave bridge unit 420. In another possible implementation, the processor 426 of the bridge unit 420 is programmed to enable the firing circuit 404 via the power control circuit 424 and the signaling 414, 414*a* only upon receipt of a command message from the master controller 440 instructing the bridge unit 420 to apply power to the firing circuit 404. This operation advantageously allows blasting operators to leave the blasting site B before any powered circuit is connected to the detonators D. In addition, the provision of the power control circuitry 424 and selective enabling/disabling of the firing circuit 404 by the slave bridge unit 420 also facilitates remote turn off, whereby the slave bridge unit processor 426 is programmed in certain embodiments to remove power from the firing circuit 404 via the control signaling or messaging 414, 414*a* if the wireless link 434 between the slave bridge unit 420 and the master controller 440 is lost or if the master controller 440 sends a message via the wireless link 434 to the bridge unit 420 with a command to turn off power to the firing circuit 404.

Referring again to FIG. 5, the master controller 440 and the slave bridge unit 420 implement two-way communications via the wireless link 434, by which the master controller 440 remotely controls the operation of the blasting machine 402 with all blasting machine functions and messages being displayed or echoed on the user interface 444 of the master controller 440. In this regard, the blasting machine 402 may have a local user interface (not shown), and may be operable in a local control mode according to a keypad and other means for receiving user inputs locally, with connection to the slave bridge unit 420 placing the blasting machine 402 into a remote control mode for operation according to the master controller 440 via the wireless link 434 and the connection to the slave bridge unit 420. In certain embodiments, echoing of the local blasting machine user interface prompts and displayed information via the bridge unit 420 to the master controller 440 enables the remote operator at the master controller 440 to safely see remotely whatever is on the blasting machine display from a distance. In addition, the system implemented by the interconnection and operation of the master controller 440, the bridge unit 420 and the blasting machine 402 performs various operations using multiple messages with acknowledgment and verification as detailed below in order to further facilitate safe and predictable operation of a remote wireless blasting system.

Figure 8A:
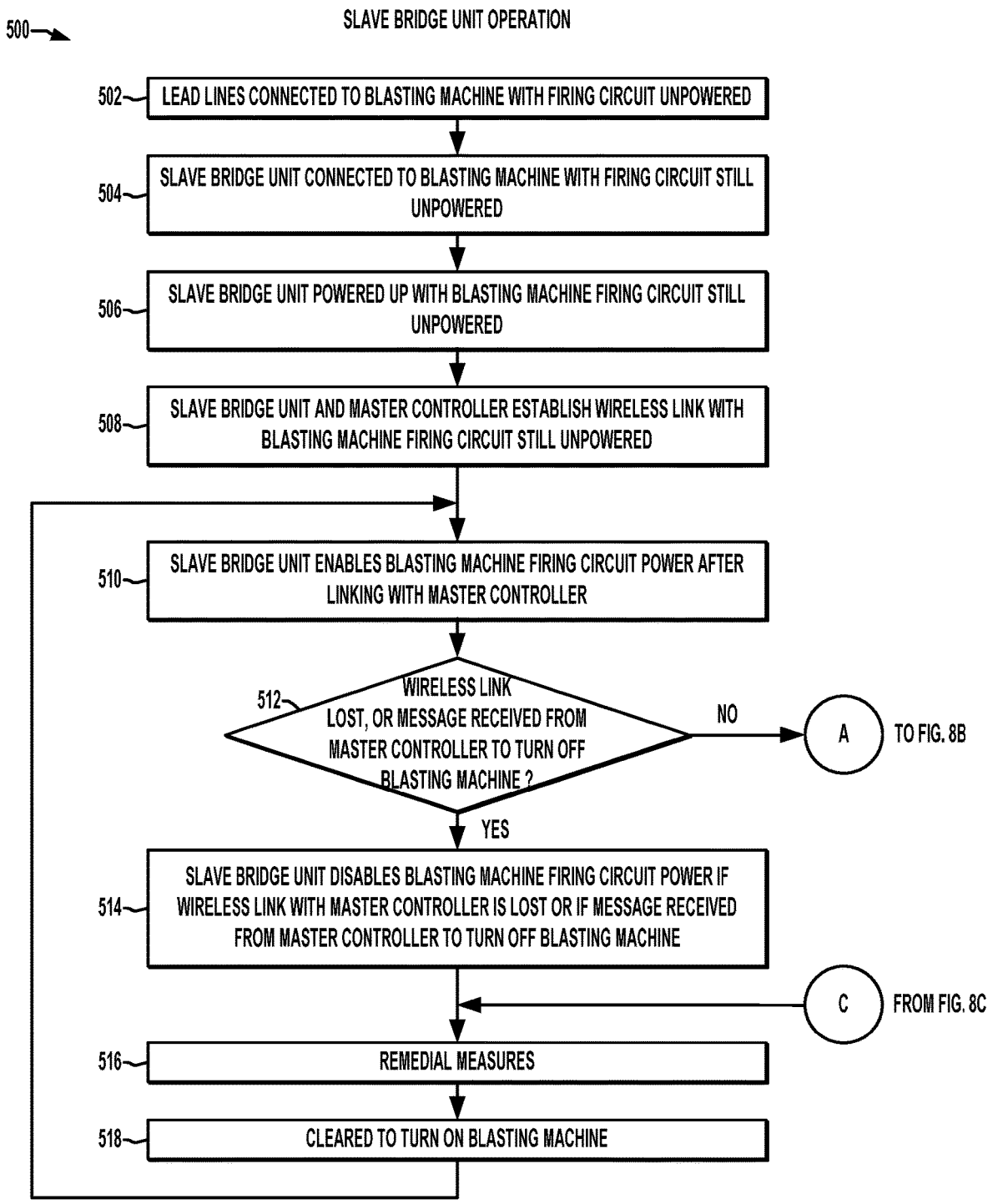
FIGS. 8A-8C provide a flow diagram illustrating an exemplary process for operating the slave bridge unit.
Figure 8B:
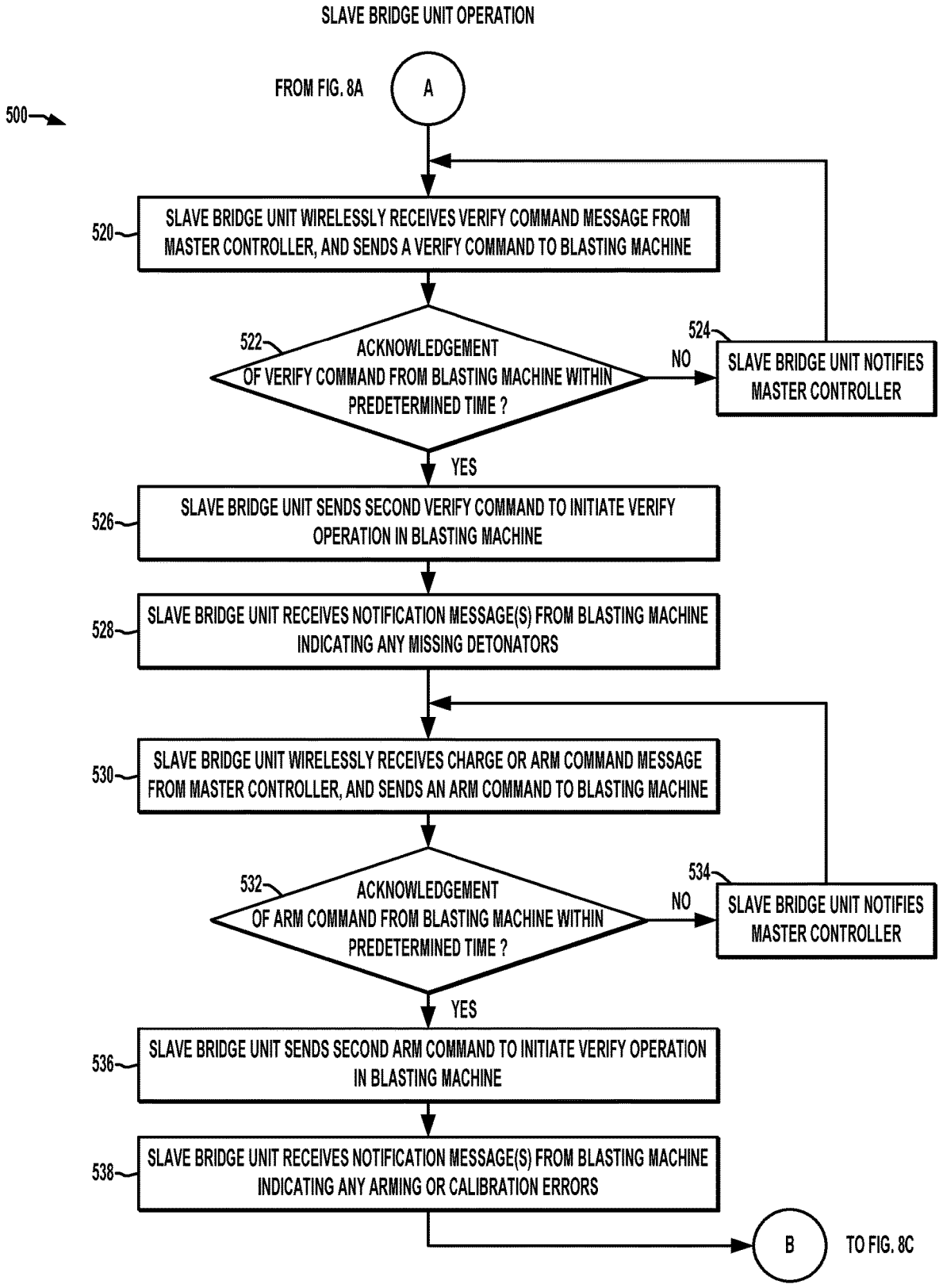
Figure 8C:
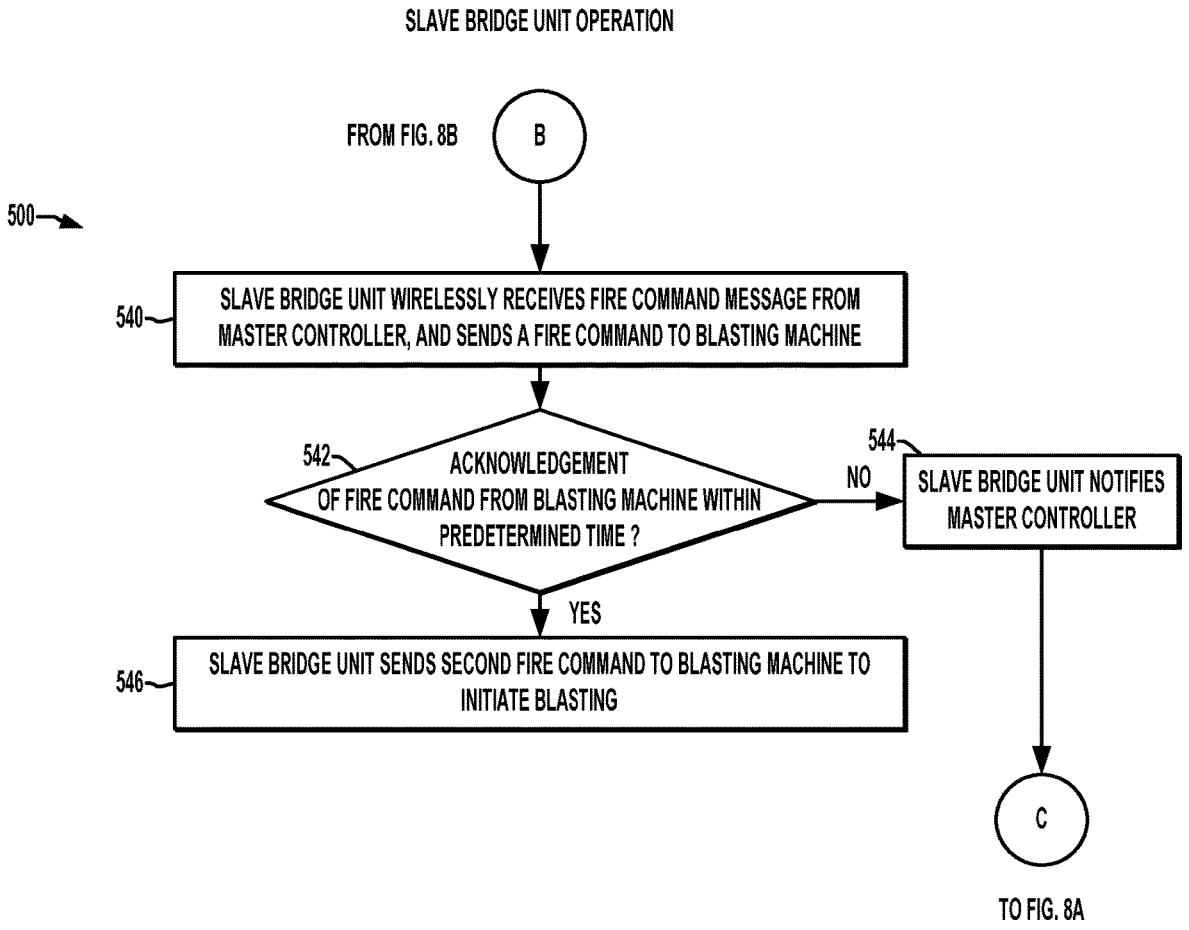
Figure 9:
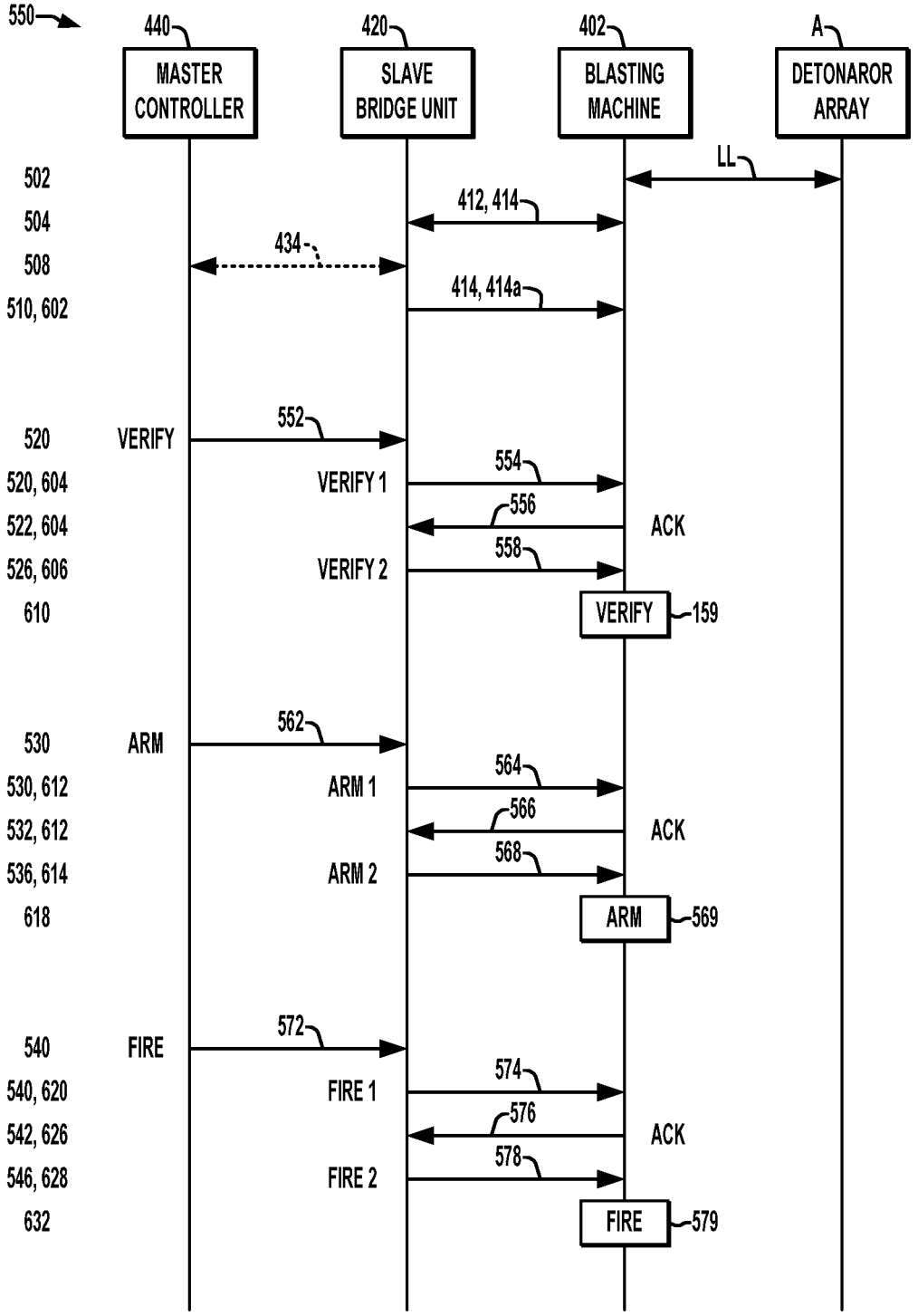
FIG. 9 is a signal flow diagram illustrating operation of the master controller, slave bridge unit and blasting machine in the system of FIG. 1.
Figure 10A:
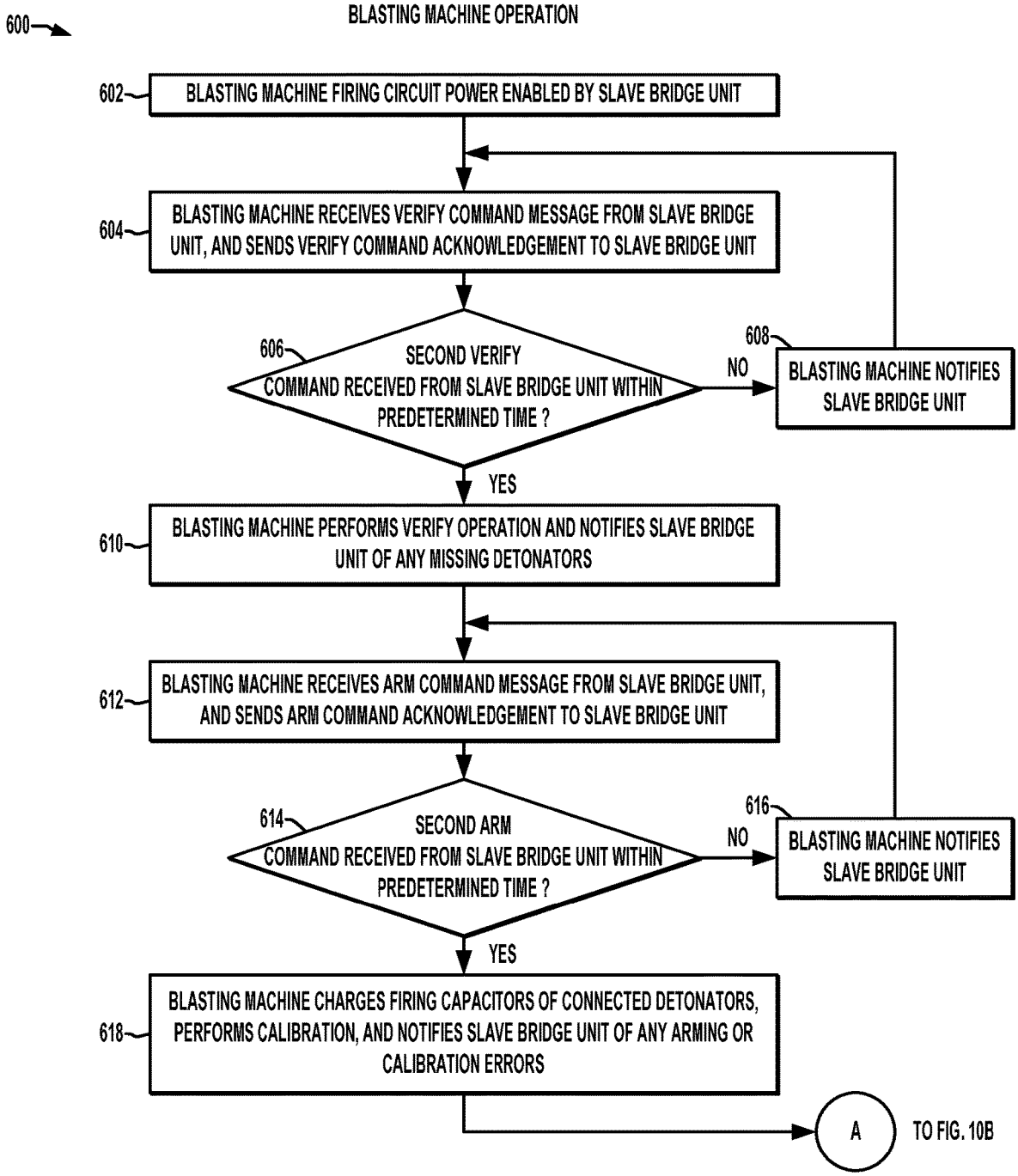
FIGS. 10A-10B provide a flow diagram illustrating an exemplary process for operating the blasting machine.
Figure 10B:
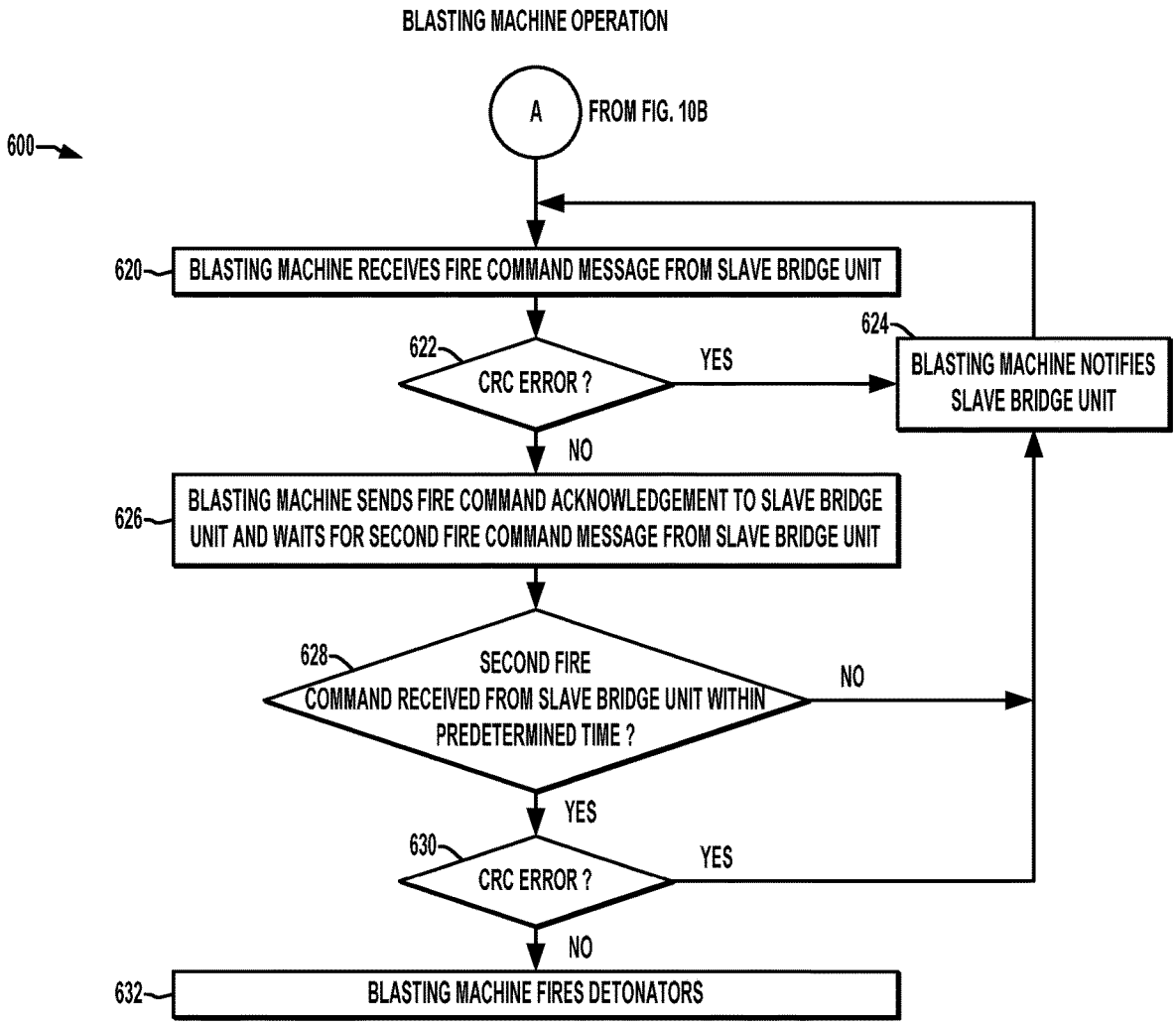

Referring now to FIGS. 8A-10B, exemplary methods 150, 600 are illustrated for implementing a remote wireless blasting operation, including a method 500 in FIGS. 8A-8C showing exemplary operation of the slave bridge unit 420, and a method 600 in FIGS. 10A and 10B for operating the blasting machine 402, along with a signal flow diagram 550 in FIG. 9 showing various interconnections and messaging between the master controller 440, slave bridge unit 420, blasting machine 402 and detonator array A. While the exemplary methods 500 and 600 are illustrated and described hereinafter in the form of a series of acts or events, it will be appreciated that the various methods of the disclosure are not limited by the illustrated ordering of such acts or events. In this regard, except as specifically provided hereinafter, some acts or events may occur in different order and/or concurrently with other acts or events apart from those illustrated and described herein in accordance with the disclosure. It is further noted that not all illustrated steps may be required to implement a process or method in accordance with the present disclosure, and one or more such acts may be combined. The illustrated methods 500, 600 and other methods of the disclosure may be implemented in hardware, processor-executed software, or combinations thereof, such as in the exemplary blasting machine 402 and slave bridge unit 420 described herein, and may be embodied in the form of computer executable instructions stored in a non-transitory computer readable medium such as the memories associated with the processors 406 and 426.

In one possible remote wireless blasting procedure, electronic detonators D are programmed and logged using one or more loggers (not shown), with detonator delay times being programmed during the logging process, or such delay times may have been previously programmed. Thereafter, the detonators D are connected to each of their individual branch wires, and a logger may be used to verify that each detonator D in a specific branch is properly electrically connected. Detonator data may then be transferred from the logger to the blasting machine 402, such as by electrical connection of the longer (not shown) to the communications interface 408 for transfer of the detonator data. Branch wires may then be connected to the lead line wiring LL, where the lead line wiring LL may extend some difference from the detonator array A to the position of the blasting machine 402.

The process 500 begins at 502 in FIG. 8A begins in one example with connection of the lead lines LL from the detonator array A to the blasting machine 402 while the blasting machine 402 and the firing circuit 404 thereof remain unpowered. On-site blasting personnel may then insert and turn the power keys 403 and 423 of the blasting machine 402 and the slave bridge unit 420, but the firing circuit 404 of the blasting machine 402 initially remains off. The slave bridge unit 420 is connected to the blasting machine 402 at 504, with the bridge unit 420 maintaining the unpowered condition of the blasting machine firing circuit 404. At 506 in FIG. 8A, the slave bridge unit 420 is powered up while still maintaining the blasting machine firing circuit 404 in the unpowered state. The blasting site B may then be cleared of personnel and/or extra equipment.

At 508, the bridge unit 420 and the master controller 440 establish a wireless communications link 434 with the blasting machine firing circuit 404 still unpowered under control of the power control circuit 424 implemented in the slave bridge unit 420. At 510 in FIG. 8A, the slave bridge unit enables the blasting machine firing circuit power after linking with the master controller 440. This is schematically illustrated in the signal flow diagram 550 of FIG. 9, in which the slave bridge unit 420 provides suitable signaling and/or messaging 414, 414A to the blasting machine 402 under control of the slave bridge unit processor 426 to initiate application of electrical power to the firing circuit 404, for example, using the relay circuit control techniques shown in FIG. 6 or 7 above. In one possible embodiment, the bridge unit 420 sends a command message "BM0" or "BM1" to the blasting machine 402, which may be acknowledged by the blasting machine 402 in certain implementations. The slave bridge unit processor 426 determines at 512 in FIG. 8A whether the wireless link 434 has been lost, or alternatively whether a message has been received from the master controller 440 including a command or instruction to turn off the blasting machine 402. If so (YES at 112), the method 500 continues to 514 where the slave bridge unit 420 disables the blasting machine firing circuit power via the power control circuit 424 and any associated signaling or messaging 414, 414*a*, and one or more remedial measures may be undertaken at 516. For instance, if the wireless link 434 was lost, blasting personnel may safely visit the blasting site B, if necessary, to service the slave bridge unit 420 or take other actions to reestablish the communications link 434. Alternatively, if the remote turn off feature was initiated by receipt of a message from the master controller 440, the blasting personnel can attend to other situations at the blast site B with the assurance that the firing circuit 404 of the blasting machine 402 has been disabled. Once the remedial measures have been undertaken at 516, blasting personnel can determine that it is now safe to again turn on the blasting machine at 518, with the process 500 returning to 510 for the slave bridge unit 420 to enable the blasting machine firing circuit power after again establishing the communications link with the master controller 440, and optionally after receiving a specific command from the master controller 40 to again power up the blasting machine firing circuit 404.

Once it is determined at 512 that the wireless link 434 is operational and no turn off messaging has been received from the master controller 440 (NO at 512 in FIG. 8A), the process 500 proceeds to 520 in FIG. 8B with the slave bridge unit 420 wirelessly receiving a verify command message from the master controller 440 (shown as a wireless verify command message 552 in FIG. 9) and sending a verify command message to the blasting machine 402 (message 554 in FIG. 9). In one possible embodiment, the blasting machine 402 receives the verify command 554 and performs one or more verification operations, while the operator at the master controller 440 may monitor the user interface 444 to verify proper interconnection of the various detonators D. In the illustrated implementation, moreover, the slave bridge unit 420 and the blasting machine 402 further ensure proper receipt of a verify command with the blasting machine 402 using two or more verify commands from the bridge unit 420 an acknowledgment by the blasting machine 402 as shown. In this case, the bridge unit 420 waits for an acknowledgment message from the blasting machine 402 at 522 in FIG. 8B. If no acknowledgment is received (NO at 522), the slave bridge unit 420 notifies the master controller 440 at 524, and the process 500 returns to await another verify command from the master controller 440 at 520. If the blasting machine 402 provides an acknowledgment (message 556 in FIG. 9) within a predetermined time (YES at 522 in FIG. 8B), the slave bridge unit 420 sends a second verify command (message 558 in FIG. 9) to the blasting machine 402 at 526 in FIG. 8B. The verify process, in this regard, may be individualized for specific detonators D, and the multiple command messaging with acknowledgment shown at 520-526 in FIG. 8B may be implemented at the beginning of a verification process, with further single messaging being used to verify individual detonators D. The slave bridge unit 420, moreover, may receive one or more notification messages at 528 in FIG. 8B from the blasting machine 2 indicating any missing detonators or other verify process status indicators, which can then be relayed via the wireless link 434 to the remote master controller 440 for display to an operator via the user interface 444.

At 530 in FIG. 8B, the slave bridge unit 420 wirelessly receives a charge or "ARM" command message (message 562 in FIG. 9) from the master controller 440, and sends an arm command to the blasting machine 402 (message 564 in FIG. 9). In certain embodiments, the blasting machine 402 responds to the first arm command and charges firing capacitors of connected detonators D, and may perform calibration processing as well, and reports any arming or calibration errors to the slave bridge unit 420, which are then forwarded to the master controller 440 for display to an operator via the user interface 444. In the illustrated implementation, the bridge unit 420 waits for an acknowledgment at 532 in FIG. 8B of the arm command from the blasting machine 402, and if no such acknowledgment is received within a predetermined time (NO at 532), notifies the master controller 440 and returns to 532 await receipt of another charge or arm command from the master controller 440. Otherwise (YES at 532), once the acknowledgment from the blasting machine 402 has been received within the predetermined time (acknowledgment message 566 in FIG. 9), the slave bridge unit 420 sends a second arm command (message 568 in FIG. 9) to the blasting machine 402 at 536 in FIG. 8B, and receives one or more notification messages at 538 from the blasting machine 402 indicating any arming our calibration errors, which are then forwarded via the wireless link 434 to the master controller 440.

Continuing in FIG. 8C, the slave bridge unit 420 wirelessly receives a fire command at 540 from the master controller 440 (message 572 in FIG. 9), and sends a fire command to the blasting machine 402 (command message 574 in FIG. 9). At 542, the bridge unit 420 waits for an acknowledgment of the fire command from the blasting machine 402, and if no acknowledgment is received within a predetermined time (NO at 542) the bridge unit 420 notifies the master controller 440 at 544, and the process returns for remedial measures at 516 in FIG. 8A. If the slave bridge unit 420 receives a proper acknowledgment of the fire command (YES at 542 in FIG. 8C, acknowledgment message 576 in FIG. 9), the slave bridge unit 420 sends a second fire command (message 578 in FIG. 9) at 546 to complete the blasting process 500. As seen in FIG. 9, moreover, this causes the blasting machine 402 in certain embodiments to fire the detonator array A at 579. In other embodiments, the slave bridge unit 420 need not implement a timeout function, and may instead continue to await receipt of a second or subsequent fire command at 542 in FIG. 8C. In certain embodiments, moreover, the blasting machine 402 may be configured to implement a predetermined timeout for receipt of the second command message 578, and if not received from the slave bridge unit 420 in the predetermined period of time, may issue a message to the slave bridge unit 420 indicating that the fire process, if intended, needs to be restarted. In addition, although illustrated and described above in the context of a dual message process with intervening acknowledgment, more than 402 fire command messages may be required, with intervening acknowledgments from the blasting machine 402, in order to fire the detonators D at 579 in FIG. 9.

In this manner, if the initial fire command message 574 was not properly received by the blasting machine 402, or if the communications interface 412 between the blasting machine 402 in the slave bridge unit 420 is inoperative or intermittent, the bridge unit 420 will not send a second or subsequent fire command to the blasting machine 402. Moreover, as discussed further below in connection with FIGS. 10A and 10B, the blasting machine 402 is adapted to await a second or subsequent fire command before actually firing the detonators D via the firing circuit 404. Consequently, the wireless blasting system of the present disclosure advantageously employs multiple fire command messaging between the blasting machine 402 and the slave bridge unit 420 in order to ensure that the blasting machine 402 only acts upon intended firing commands. In this regard, should the blasting machine 402 inadvertently receive a different command or spurious noise via of the communications interface 408 which is interpreted as being a single fire command, without the slave bridge unit 420 actually intending to cause the detonators D to be fired, no unintended firing will be initiated by the blasting machine 402. Consequently, this aspect of the present disclosure facilitates safe controlled detonation of the detonator array A and presents a significant robust system architecture providing an advance over conventional wireless blasting systems which could be susceptible to misinterpretation of single firing command messages or signals.

Referring also to FIGS. 10A and 10B, the process 600 illustrates exemplary operation of the blasting machine 402 in conjunction with the above-described bridge unit operation in FIGS. 8A-8C and 9. At 602 in FIG. 10A, the blasting machine firing circuit power is enabled by the slave bridge unit (signaling 414, 414*a* in FIG. 9). At 604, the blasting machine 402 receives a verify command message (message 554 in FIG. 9) and sends a verify command acknowledgment in certain embodiments to the slave bridge unit 402 (acknowledgment 556 in FIG. 9). As mentioned previously, certain embodiments of the blasting machine 402 and slave bridge unit 420 may provide for single messaging for verify operation, with or without acknowledgment. In the illustrated example, the blasting machine 402 waits at 606 in FIG. 10A for a second verify command to be received from the slave bridge unit 420, and if no second or subsequent verify command is received (NO at 606), the blasting machine 402 notifies the slave bridge unit 420 at 608, and returns to 604 as described above. If the second verify command (message 558 in FIG. 9) is received within a predetermined time (YES at 606), the blasting machine 402 performs one or more verification operations at 610 and may notify the slave bridge unit 420 of any missing (unverified) detonators D. In certain embodiments, moreover, the blasting machine 402 performs a remote out of sync prevention process 600 as further described below in connection with FIG. 12 to selectively perform the verification operation or operations at 610 after verifying synchronization with the master controller 440.

At 612 in FIG. 10A, the blasting machine 402 receives an arm command message (message 564 in FIG. 9) from the slave bridge unit 420, and sends an arm command acknowledgment (message 566 in FIG. 9) to the slave bridge unit 420. In certain embodiments, the blasting machine 402 may be programmed to initiate detonator arming in response to the first arm command message 564, with or without sending any acknowledgment message 576. In the illustrated implementation, moreover, the blasting machine 402 waits at 614 in FIG. 10A for receipt of a second arm command from the slave bridge unit 420 (arm command 568 in FIG. 9), and may implement a timeout period in certain embodiments. If a second arm command is not received within the optional predetermined time period (NO at 614), the blasting machine 402 notifies the slave bridge unit at 616 and returns to await a first verify command message at 612 as described above. Otherwise (YES at 614), the machine 402 charges the firing capacitors of the connected detonators D and performs calibration at 618, and may notify the slave bridge unit 420 of any arming or calibration errors. As discussed further below in connection with FIG. 12, certain embodiments of the blasting machine 402 implement a remote out of sync operation before charging the firing capacitors and performing other operations at 618.

The process 200 then continues at 620 in FIG. 10B, where the blasting machine 402 receives a fire command message (message 574 in FIG. 9) from the bridge unit 420, and performs a cyclical redundancy check (CRC) evaluation at 622 to determine whether the received fire command message 574 is correct. If there is a CRC error (YES at 622), the blasting machine 402 notifies the slave bridge unit 420 at 624 that an erroneous message has been received, and returns to await retransmission of any valid fire command message at 620. If there was no CRC error in the first fire command message (NO at 622), the blasting machine sends a fire command acknowledgment (message 576 and FIG. 9) to the slave bridge unit 420, and waits for receipt of a second or subsequent fire command message from the bridge unit 420 at 626. If a second or subsequent fire command message (e.g., second fire command message 578 in FIG. 9) is received at 628 from the slave bridge unit 420 (YES at 628), a CRC error check is performed at 630 by the blasting machine 402. If no CRC error occurs in the second received fire command message (NO at 630), the blasting machine fires the detonators D at 632 to complete the blasting process. In certain embodiments, moreover, even if the second fire command message is properly received without CRC errors, the blasting machine 402 verifies synchronization with the remote master controller 440 via a process 800 in FIG. 12 before firing the detonators at 632, as described further below.

The firing of the detonators at 632 can be by any suitable operation of the blasting machine using the firing circuit 404. For example, where electronic detonators D are used, the blasting machine 402 may issue a fire command at 632 in FIG. 10B along the lead lines LL to cause the detonators D to fire according to any programmed delay times in the detonators D (also shown at 579 in FIG. 9). As previously discussed, moreover, although the operation in FIG. 10B illustrates usage of first and second fire commands 574 and 578 with an intervening acknowledgment message 576 by the blasting machine 402, other implementations are possible in which more than two fire command messages must be received before the blasting machine 402 will fire the detonators at 632. Further, while the blasting machine 402 implements a timeout period in the determination at 628 in FIG. 10B, other implementations are possible in which no timeout period is used, and the blasting machine 402 will fire the detonators D in response to receipt of the second (or subsequent) fire command message 578. In cases where a CRC error occurs at 622 or 630, moreover, the blasting machine 402 will notify the slave bridge unit 420 at 624, and will itself treat the received fire command message(s) as invalid or as an automatic abort command, and thus the blasting machine 402 will not cause the detonators D to be fired.

Figure 11:
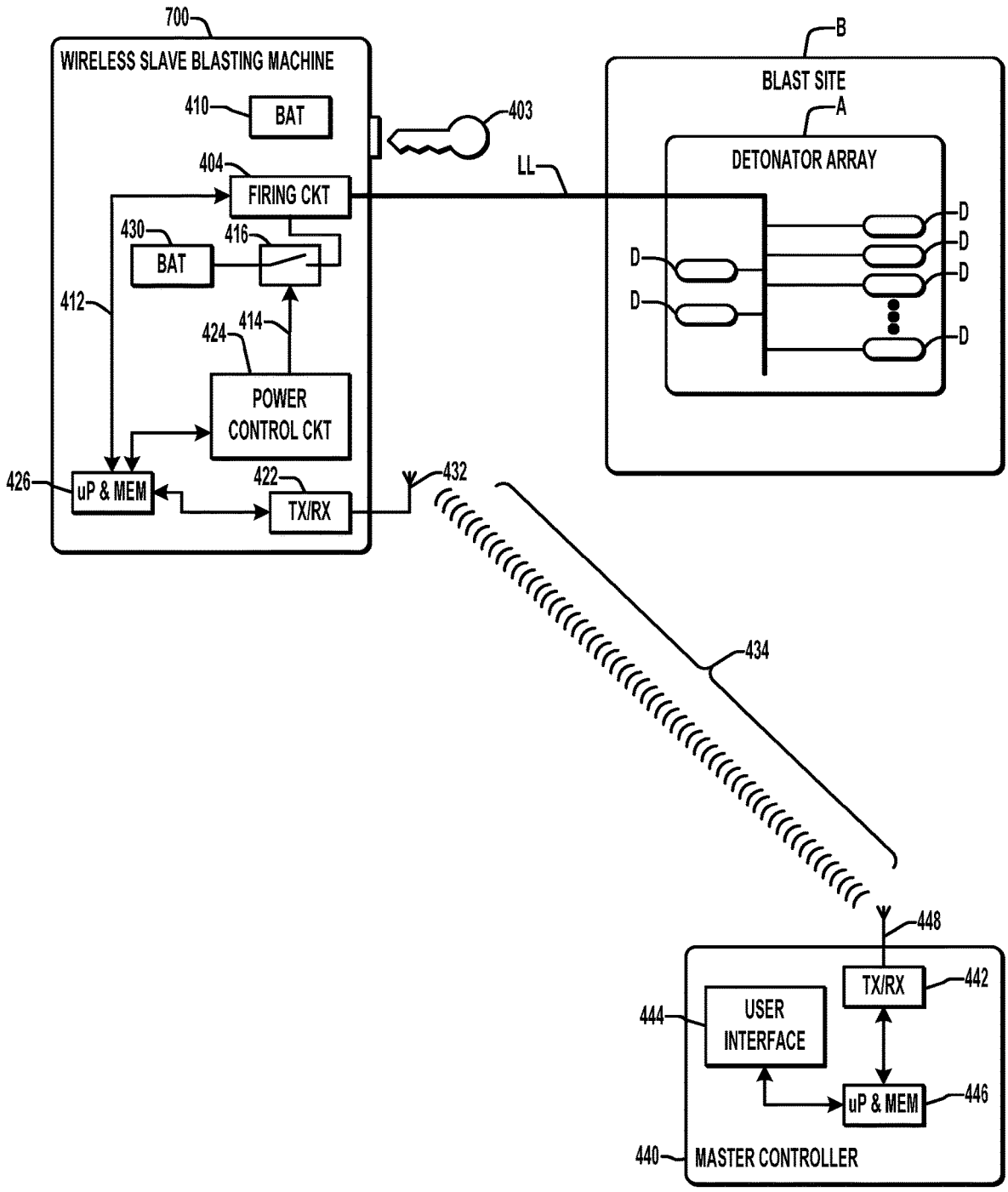
FIG. 11 is a simplified system diagram illustrating an alternate wireless blasting system with a wireless slave blasting machine in accordance with further aspects of the present disclosure.

FIG. 11 illustrates another wireless blasting system with a wireless slave blasting machine 700 according to further aspects of the present disclosure. In this case, the blasting machine 700 is equipped with a wireless transceiver 422 and associated wireless antenna 432 for wireless (e.g., RF) communications 434 with the master controller 440. In addition, the wireless slave blasting machine 700 in this example includes a firing circuit 404 for connection to the lead lines LL of the detonator array A, and may be selectively operable by way of a key 403, and/or the unit 300 may be password-protected in certain implementations. The wireless slave blasting machine 700 in general implements the functions and features of the slave bridge unit 420 and the blasting machine 402 of FIG. 5, and includes a power control circuit 424 operative to selectively enable or disable provision of power to a firing circuit 404 connected to one or more detonators D as shown, for example, using a power control circuit 424 and a relay 416 as described above. In addition, the blasting machine 700 includes one or more batteries 430 to power various internal circuitry and the firing circuit 404 by way of a power control relay 416 as described above.

The processor 426 of the wireless slave blasting machine 700 in certain embodiments is programmed to receive a first wireless fire command message (e.g., like command 572 above) from the master controller 440 via the wireless transceiver 422 using the wireless connection 434, as well as to receive a second wireless fire command message from the master controller 440, and to selectively fire one or more connected detonators D via the firing circuit 404 only after receiving both the first and second fire command message from the master controller 440 via the wireless transceiver 422. In certain embodiments, the wireless blasting machine 700 will only fire the detonators D if the first and second fire command messages are received from the master controller 440 within a predetermined time period. In certain embodiments, moreover, the wireless blasting machine 700 will send a fire command acknowledgment message to the master controller 440 via the wireless transceiver 422 in response to receiving the first fire command message 572. Moreover, the wireless slave blasting machine 700 in certain embodiments implements remote turn on/off, with the processor 426 being programmed to selectively enable or disable the firing circuit 404 (e.g., via the power control circuit 424 providing a relay control signal 414 to the relay 416 in FIG. 11) in response to wirelessly receiving a remote turn on or remote turn off command from the master controller 440.

In certain related aspects, the master controller 440, and the processor 446 thereof, may be programmed to receive an input from an operator (e.g., via the user interface 444) for initiation of a firing operation, and to automatically wirelessly transmit first and second firing command messages via the wireless link 434 to the wireless slave blasting machine 700 of FIG. 11. In one implementation, the master controller 440 sends the second firing command message within a predetermined time following transmission of the first firing command message. In certain implementations, moreover, the master controller 440 will selectively transmit the second firing command message only in response to receipt of a firing command acknowledgment message received through the wireless link 434 from the wireless slave blasting machine 700.

In accordance with further aspects of the disclosure, the slave bridge unit 420 and blasting machine 402 (e.g., FIG. 5) and/or the wireless slave blasting machine (FIG. 11) implement remote turn on/turnoff operation according to commands from the master controller 440, independent of specific fire command operation of these devices. In this manner, the operator at the master controller 440 may selectively disable the firing circuit 404 through transmission of a disable message from the master controller 440 to either a wireless slave blasting machine 700 as set forth in FIG. 11 or to a wireless slave bridge unit 420 as seen in FIG. 5. Also, the operator may use the master controller 440 to wirelessly send an enable command or message via the wireless link 434 to either the wireless slave blasting machine 700 or to a slave bridge unit 420 in order to remotely enable (e.g., power) the corresponding firing circuit 404.

In accordance with further aspects of the present disclosure, the multiple fire command message concepts (and/or multiple verify and multiple arm message concepts), alone or in further combination with the associated predetermined times and/or acknowledgment message concepts, may be implemented in association with multiple slave bridge units 420 and/or multiple wireless enabled slave blasting machines 700 or combinations thereof. In this manner, a single master controller 440 can wirelessly control multiple bridge units 420 and/or multiple wireless blasting machines 700 with respect to detonator firing operations and other associated tasks such as verification and/or arming. Moreover, the remote turn on/turnoff features of the illustrated and described master controller 440, wireless slave blasting machine 700 and slave bridge units 420 can be implemented in systems having a single master controller 440 operatively coupled via corresponding wireless links 434 to multiple slave blasting machines 700, or multiple slave bridge units 420, or combinations thereof, by which the master controller 440 may selectively enable or disable multiple firing circuits 404.

Figure 12:
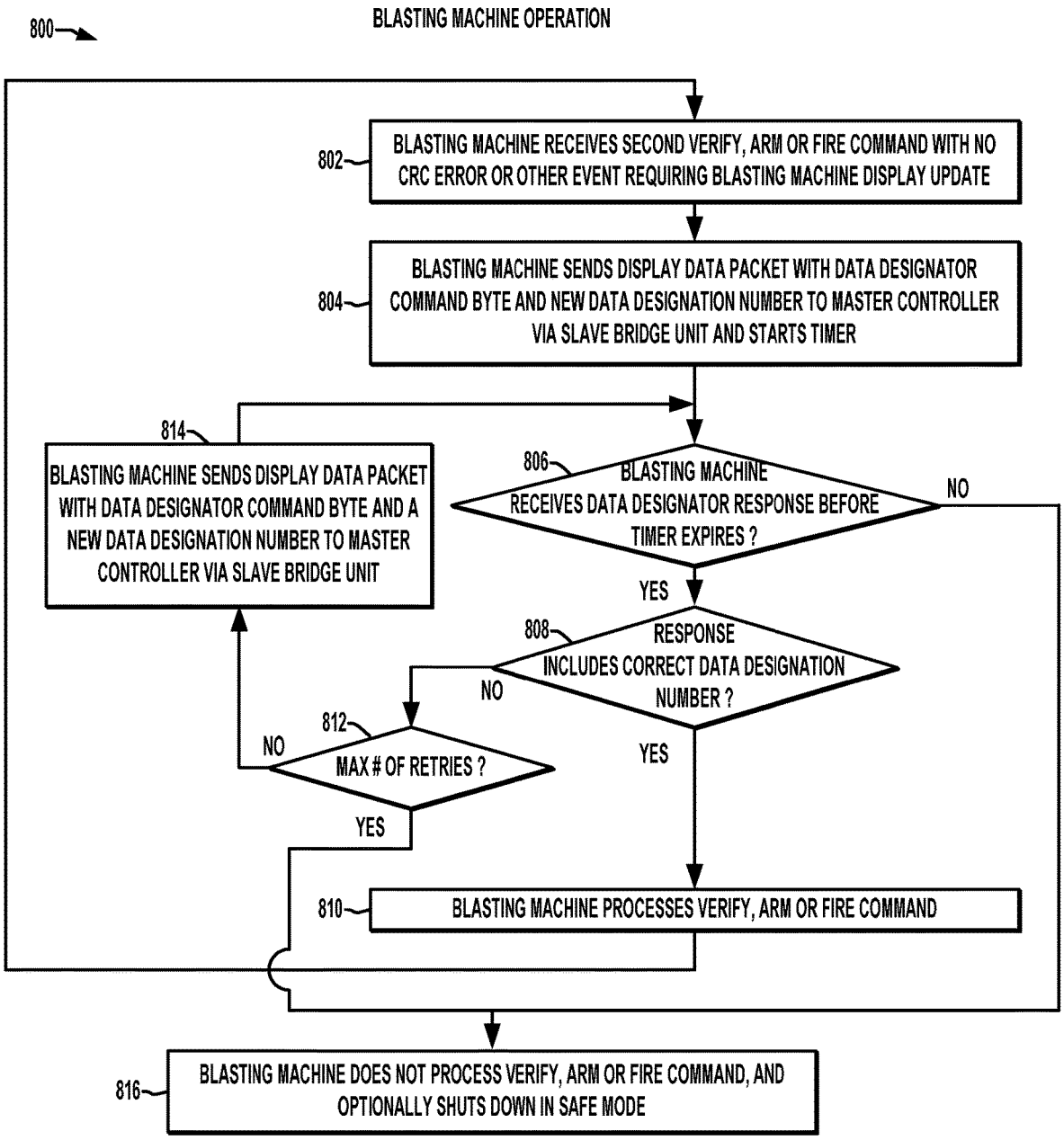
FIG. 12 is a flow diagram illustrating a data designation process to prevent remote out-of-sync conditions between the blasting machine and the remote master controller.

Referring now to FIG. 12, certain embodiments of the blasting machine 402, 700, any included slave bridge unit 420, and the master controller 440 are configured to implement a data designation process 800 to prevent one or more operations if remote out-of-sync conditions are detected between the blasting machine 402, 700 and the remote master controller 440. In particular, when the blasting machine 402, 700 receives a second verify, arm or fire command (e.g., at 606 or 614 in FIG. 10A or at 628, 630 in FIG. 10B) or any other event occurs at 802 in FIG. 12 for which the blasting machine 402, 700 updates its display, the blasting machine 402, 700 sends a wireless display data packet or other message to the master controller 440 at 804, either directly as per the blasting machine 700 in FIG. 11, or indirectly through an associated slave bridge unit 420 as shown in FIG. 9 above. This first out of sync prevention message at 804 includes the updated display data for updating the remote master controller 440, as well as a data designator command, such as a command bite, and a data designation number determined by the blasting machine 402, 700. In addition, the blasting machine 402, 700 starts a timer at 804 to establish a predetermined time following transmission of the first message.

If the blasting machine 402, 700 and the master controller 440 are synchronized properly with a functioning direct or indirect wireless communications link established, the master controller 440 receives the first message and processes the display data to update its own display, and sends a wireless "Data Designator" response message back to the blasting machine 402, 700 directly or through any associated slave bridge unit 420. The response message includes the data designation number originally transmitted from the blasting machine 402, 700 at 804 in FIG. 12. At 806, the blasting machine 402, 700 determines whether the data designator response message was received before expiration of the timer started at 804. If so (YES at 806), the blasting machine 402, 700 determines at 808 whether the response message includes the correct data designation number provided with the display data packet at 804. If so (YES at 808), the blasting machine 402, 700 processes the received verify, arm or fire command (e.g., at 610 or 618 in FIG. 10A, or at 632 in FIG. 10B above). Thereafter, the process 800 returns to 802 as described above. If the blasting machine 402, 700 does not receive any data designator response before the timer expires (NO at 806), the blasting machine at 816 refrains from processing the requested verify, arm or fire command, and may optionally shut down in a safe mode.

If, however, the blasting machine 402, 700 receives a data designator response before expiration of the timer (YES at 806) but the response does not include the correct data designation number (NO at 808), the blasting machine 402, 700 determines at 812 whether a predetermined maximum number of retransmissions of the display data packet has occurred. If not (NO at 812), the blasting machine 402, 700 sends another display data packet with the data designator command bite and a new data designation number at 814 to the master controller 440 (e.g., via a slave bridge unit 420 or directly), and returns to 806 to await a response from the master controller 440. If the blasting machine 402, 700 receives a response to the second message including the new data designator number (YES at 808), the requested verify, arm or fire command is processed at 810. In addition, this retransmission attempt processing at 806, 808, 812 and 814 can repeat until the predetermined maximum number of retries has occurred (YES at 812) or until the timer expires without receipt of a data designator response message including the most recent data designation number (NO at 816), in which case the blasting machine 402, 700 refrain from processing the verify, arm or fire command at 816, and may optionally shut down in the safe mode. In this manner, the master controller 420 and the blasting machine 402, 700 are ensured to be synchronized before performance of critical operations by the blasting machine 402, 700, and the display data presented to an operator at the remote master controller 414 correctly reflects the display data at the blasting machine 402, 700.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, processor-executed software and/or firmware, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been disclosed with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising."

The following is claimed:

1. A blasting system, comprising:

a blasting machine wired to an array of detonators;

a switch connected to the blasting machine;

a router connected to the switch;

an Ethernet controller configured to:

communicate with the blasting machine via the switch and the router using an Ethernet communications protocol to control operation of the blasting machine remotely, and display at least one function, message, or status of the blasting machine on a display associated with the controller; and a protected Ethernet connection box operatively coupled in one or more connection paths between the Ethernet controller and the blasting machine, including clamping elements in the protected Ethernet connection box and configured to protect network elements including at least one of the blasting machine, the switch, the router, and the Ethernet controller against electrical after effects associated with a blast or detonation.

2. The blasting system of claim 1, wherein the blasting machine contains sufficient energy and voltage to charge firing capacitors in the array of detonators.

3. The blasting machine of claim 2, wherein the blasting machine is not energized until remotely commanded via the controller, the switch and the router.

4. The blasting system of claim 1, wherein the Ethernet controller is configured to transfer a fire command to the blasting machine via the switch and the router to initiate blasting of the array of detonators.

5. The blasting system of claim 1, wherein the Ethernet controller is configured to transfer a fire command to the blasting machine via the switch and the router, and to thereafter transfer a final fire command to the blasting machine via the switch and the router to initiate blasting of the array of detonators.

6. The blasting system of claim 5, wherein the Ethernet controller is configured to transfer cyclical redundancy codes associated with the fire command and the final fire command to the blasting machine via the switch and the router.

7. The blasting system of claim 6, wherein the blasting machine is configured to check for CRC errors, to invalidate the fire command or the final fire command if a CRC error is detected, and to send an acknowledgment to the Ethernet controller via the switch and the router if no CRC error is detected.

8. The blasting system of claim 1, wherein the blasting machine is configured to turn off after a predetermined time if no communication is detected from the Ethernet controller.

9. The blasting system of claim 1, wherein the Ethernet controller is configured to send multiple fire commands and to receive corresponding acknowledgements from the blasting machine.

10. The blasting system of claim 9, wherein the blasting machine is configured to acknowledge reception of the fire commands to the Ethernet controller, and wherein the Ethernet controller is configured to implement an abort of a firing if the blasting machine does not properly acknowledge the fire commands.

11. The blasting system of claim 1, further comprising multiple instances of the blasting machine, each instance of the blasting machine having a unique Ethernet address, wherein the Ethernet controller is configured to synchronize firing of the multiple blasting machines by issuing two broadcast fire commands with different pre-countdown times to a delay time, and wherein each instance of the blasting machine is configured to acknowledge reception of the fire commands to the Ethernet controller.

12. The blasting system of claim 1, further comprising multiple Ethernet addressable switches configured to selectively turn off or on branch lines to a main leadline during logging or blasting operation.

13. The blasting system of claim 1, further including one or more security keys that must be entered or inserted in order to enable the blasting machine to communicate with the array of the detonators.

14. The blasting system of claim 1, wherein the clamping elements of the protected Ethernet connection box include a zener diode configured to protect the network elements against the electrical after effects associated with the blast or detonation.

15. The blasting system of claim 1, wherein the clamping elements of the protected Ethernet connection box include a transient voltage suppressor (TVS) configured to protect the network elements against the electrical after effects associated with theft blast or detonation.

16. The blasting system of claim 1, wherein the clamping elements of the protected Ethernet connection box include a silicon controlled rectifier (SCR) configured to protect the network elements against the electrical after effects associated with theft blast or detonation.

17. The blasting system of claim 1, wherein: the electrical after effects associated with the blast or detonation include plasma after effects; and the clamping elements of the protected Ethernet connection box are configured to protect the network elements against the plasma after effects.

18. The blasting system of claim 1, wherein: the electrical after effects associated with the blast or detonation include high voltage electromagnetic (EM) field effects; and the clamping elements of the protected Ethernet connection box are configured to protect the network elements against the high voltage electromagnetic (EM) field effects.

* * * * *